US009466880B2

(12) United States Patent
Choi et al.

(10) Patent No.: US 9,466,880 B2
(45) Date of Patent: Oct. 11, 2016

(54) PATCH ANTENNA HAVING A PATCH FED WITH MULTIPLE SIGNAL

(71) Applicant: KOREA ELECTRONICS TECHNOLOGY INSTITUTE, Seongnam-si, Gyeonggi-do (KR)

(72) Inventors: Se Hwan Choi, Seongnam-si (KR); Jae Young Lee, Suwon-si (KR)

(73) Assignee: KOREA ELECTRONICS TECHNOLOGY INSTITUTE, Seongnam-si, Gyeonggi-do (KR)

( * ) Notice: Subject to any disclaimer, the term of this patent is extended or adjusted under 35 U.S.C. 154(b) by 670 days.

(21) Appl. No.: 13/886,316

(22) Filed: May 3, 2013

(65) Prior Publication Data

US 2014/0176369 A1 Jun. 26, 2014

(30) Foreign Application Priority Data

Dec. 26, 2012 (KR) ..... 10-2012-0153117

(51) Int. Cl.
*H01Q 1/50* (2006.01)
*H01Q 9/04* (2006.01)

(52) U.S. Cl.
CPC ..... *H01Q 1/50* (2013.01); *H01Q 9/0407* (2013.01); *H01Q 9/0435* (2013.01)

(58) Field of Classification Search
CPC .... H01Q 9/0407; H01Q 9/0435; H01Q 1/50; H01Q 9/0414; H01Q 9/0428
USPC ..... 343/700 MS
See application file for complete search history.

(56) References Cited

U.S. PATENT DOCUMENTS

| | | | | |
|---|---|---|---|---|
| 6,424,299 | B1 * | 7/2002 | Cha | H01Q 9/0435 343/700 MS |
| 7,619,568 | B2 * | 11/2009 | Gillette | H01Q 1/38 343/700 MS |
| 2011/0199279 | A1 * | 8/2011 | Shen | H01Q 9/0414 343/857 |
| 2012/0212376 | A1 * | 8/2012 | Jan | H01Q 9/0414 343/700 MS |
| 2015/0180116 | A1 * | 6/2015 | Sato | H01Q 21/24 343/841 |

FOREIGN PATENT DOCUMENTS

| | | | |
|---|---|---|---|
| KR | 1020030017214 | A | 3/2003 |
| KR | 1020050062082 | A | 6/2005 |

OTHER PUBLICATIONS

Korean Office Action for application No. 10-2012-0153117 dated Feb. 24, 2014.

* cited by examiner

*Primary Examiner* — Sue A Purvis
*Assistant Examiner* — Daniel J Munoz
(74) *Attorney, Agent, or Firm* — Hauptman Ham, LLP

(57) ABSTRACT

A patch antenna having a single patch fed with multiple signals is provided. The patch antenna includes: a first patch; a first feeder and a second feeder which are connected to the first patch; and a second patch which is parallel to the first patch. Accordingly, since multiple signals can be fed into a single patch, a MIMO antenna can be embodied by using a patch antenna which has high isolation between feeders without increasing its size.

6 Claims, 6 Drawing Sheets

PATCH ANTENNA HAVING A PATCH FED WITH MULTIPLE SIGNAL

CROSS-REFERENCE TO RELATED APPLICATION

This application claims priority from Korean Patent Application No. 10-2012-0153117, filed on Dec. 26, 2012 in the Korean Intellectual Property Office, the disclosure of which is incorporated herein by reference in its entirety.

BACKGROUND

1. Field

Methods and apparatuses consistent with exemplary embodiments relate to a patch antenna, and more particularly, to a patch antenna which is fed with signals through a power divider.

2. Description of the Related Art

If a multiple input multiple output (MIMO) antenna is implemented in a related-art antenna implementing method, isolation between feeders is not high and thus the feeders affect each other's signals, thereby attenuating advantages of the MIMO antenna.

On the other hand, there is a disadvantage of having to increase the size of the antenna several times greater than that of a single antenna to have high isolation.

Therefore, there is a demand for a method for designing an antenna that is configured to improve performance by increasing isolation between feeders without increasing a size of the antenna.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a patch antenna which can have high isolation between feeders without increasing its size when a MIMO antenna is designed.

According to an aspect of an exemplary embodiment, there is provided a patch antenna including: a first patch; a first feeder which is connected to the first patch; a second feeder which is connected to the first patch; and a second patch which is parallel to the first patch.

The first feeder and the second feeder may be connected to two adjacent sides of the first patch, respectively.

The first feeder may be fed with power through a first power divider, and the second feeder may be fed with power through a second power divider.

The patch antenna may further include metal sidewalls which are disposed between a first substrate in which the first patch is provided and a second substrate in which the second patch is provided.

The metal sidewalls may be formed in a cavity-back structure.

The first feeder may receive a first common signal or a first differential signal, and the second feeder may receive a second common signal or a second differential signal.

The first patch and the second patch may transmit and receive linearly polarized waves or circularly polarized waves.

According to the exemplary embodiment as described above, since multiple signals can be fed into a single patch, a MIMO antenna can be embodied by using a patch antenna which has high isolation between feeders without increasing its size.

BRIEF DESCRIPTION OF THE DRAWING FIGURES

The above and/or other aspects will be more apparent by describing in detail exemplary embodiments, with reference to the accompanying drawings, in which.

DETAILED DESCRIPTION OF EXEMPLARY EMBODIMENTS

Figure 1:
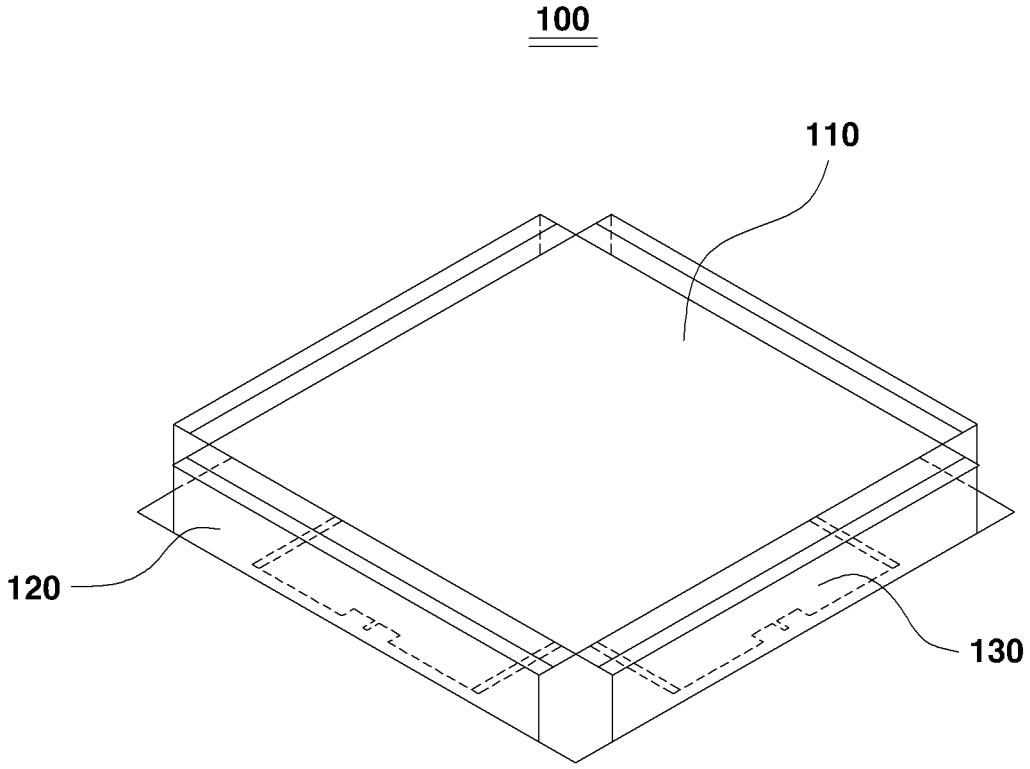
FIG. 1 is a perspective view illustrating a patch antenna according to an exemplary embodiment.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of exemplary embodiments. Thus, it is apparent that exemplary embodiments can be carried out without those specifically defined matters. Also, functions or elements known in the related art are not described in detail since they would obscure the exemplary embodiments with unnecessary detail.

FIG. 1 is a perspective view illustrating a patch antenna according to an exemplary embodiment. As shown in FIG. 1, a patch antenna 100 according to an exemplary embodiment includes an upper substrate 110, a frame 120, and a lower substrate 130.

Specifically, the patch antenna 100 according to an exemplary embodiment is configured to have the lower substrate 130 disposed in the frame 120 and the upper substrate 110 covering an upper portion of the frame 120.

The upper substrate 110 and the lower substrate 130 of the patch antenna 100 are arranged in parallel with each other due to the presence of the frame 120. Also, the frame 120 of the patch antenna 100 has a side surface formed in a cavity-back structure.

Figure 2:
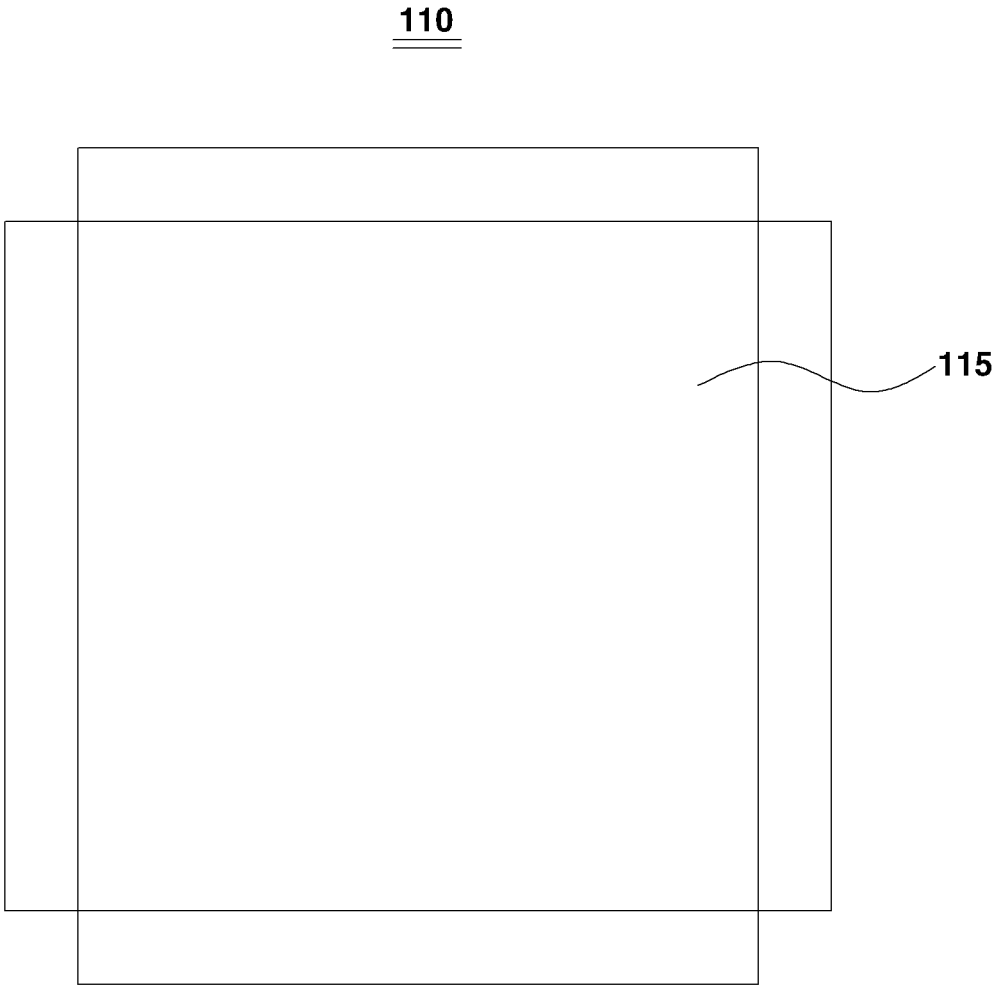
FIG. 2 is a bottom view of an upper substrate of FIG. 1 viewed from the bottom.

FIG. 2 is a bottom view of the upper substrate 110 of FIG. 1 viewed from the bottom. As shown in FIG. 2, the upper substrate 110 is provided with an upper patch 115.

The upper patch 115 of the patch antenna 100 according to the exemplary embodiment is implemented in a square shape. However, this is merely an example. The upper patch 115 may be implemented in a shape other than the square shape.

Figure 3:
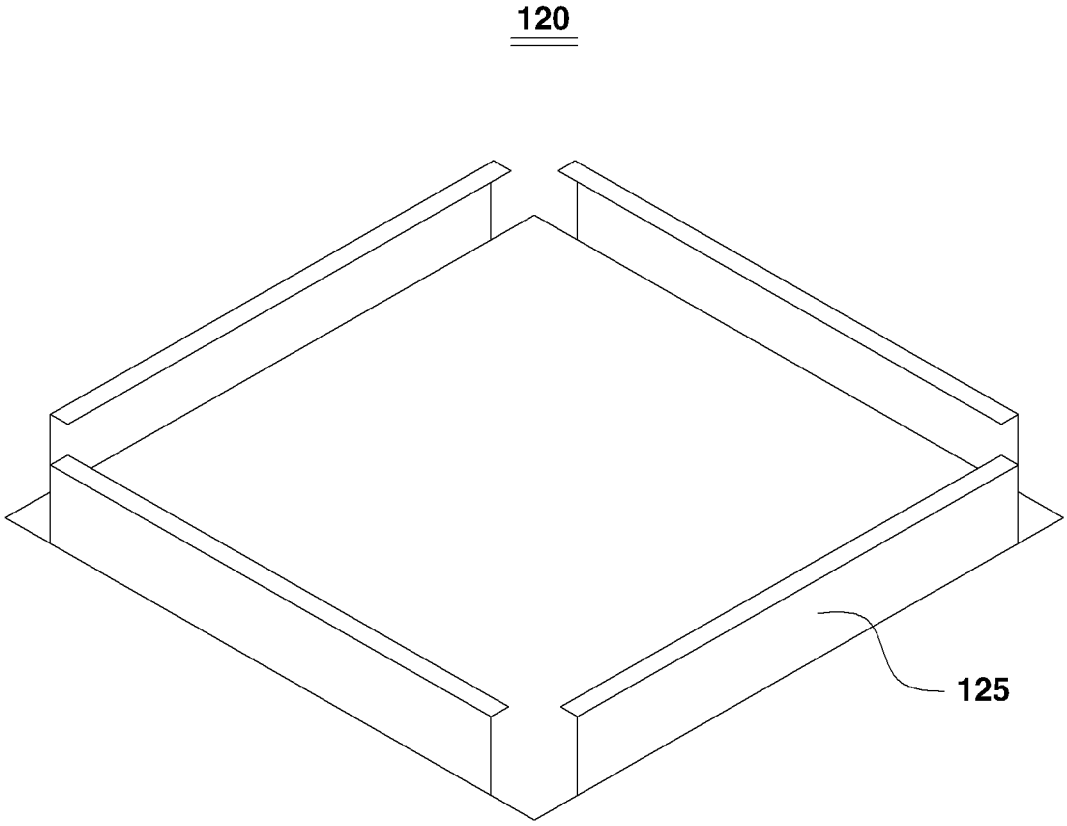
FIG. 3 is a perspective view illustrating a frame which is separated from the patch antenna of FIG. 1.
Figure 4:
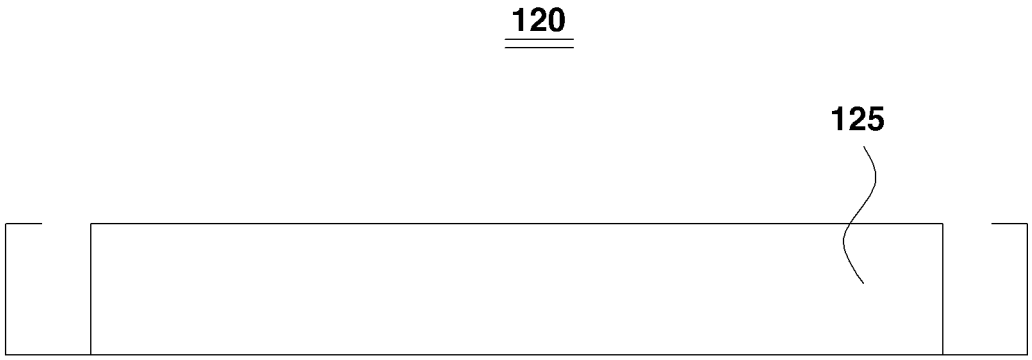
FIG. 4 is a side view of the frame of FIG. 3 viewed from the side.

FIG. 3 is a perspective view illustrating the frame 120 which is separated from the patch antenna 100 of FIG. 1. FIG. 4 is a side view of the frame 120 of FIG. 3 viewed from the side.

As shown in FIGS. 3 and 4, metal sidewalls 125 are formed on four sides of the frame 120 except corners. The metal sidewall 125 is implemented in a cavity-back structure and prevents electromagnetic waves from being discharged through a rear surface of the patch antenna 100, thereby collecting the electromagnetic waves on a front side of the patch antenna 100.

The metal sidewall 125 of the cavity-back structure may increase a front-back ratio of the patch antenna 100 and simultaneously may prevent a size of the patch antenna 100 from being increased.

Figure 5:
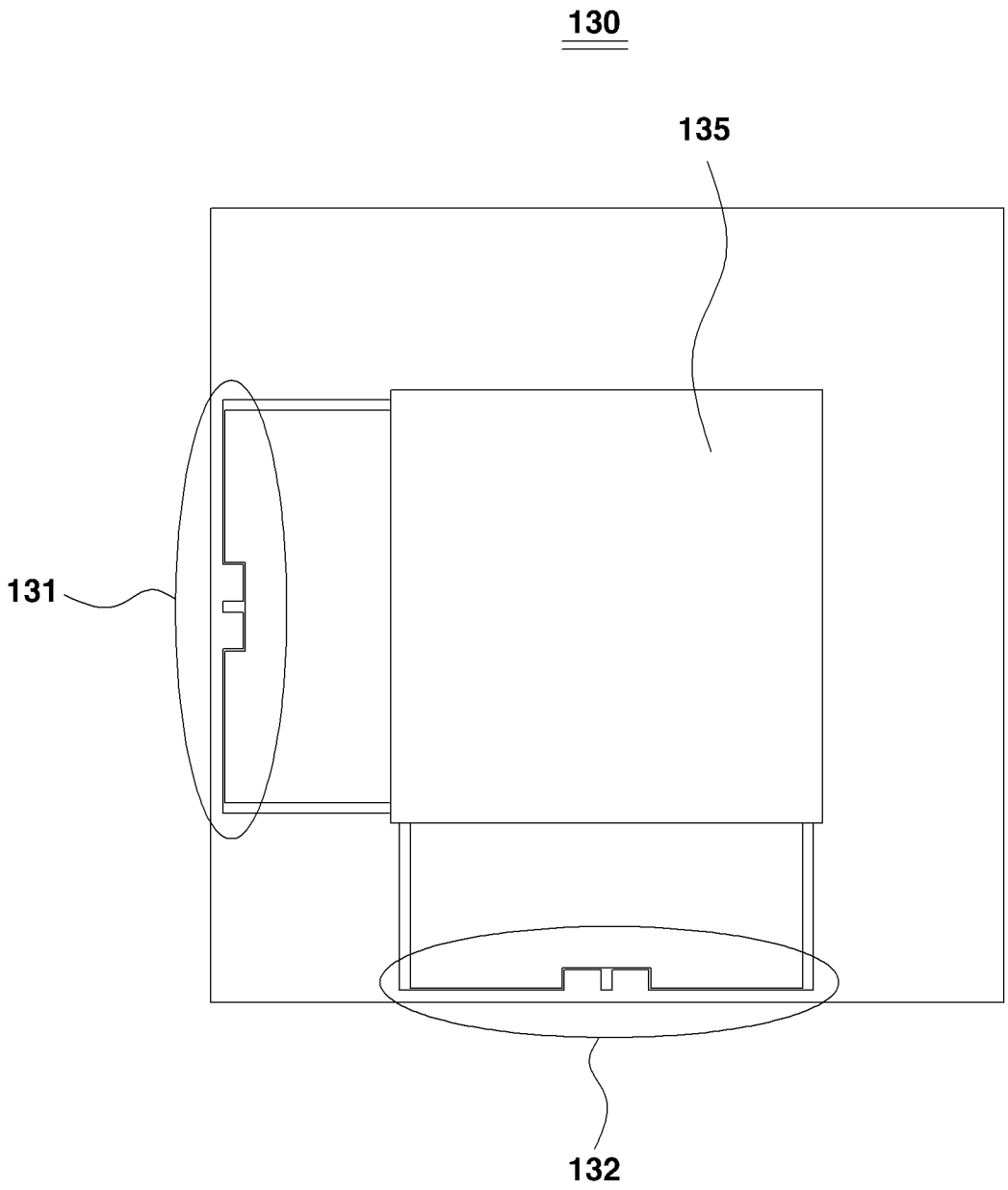
FIG. 5 is a top view illustrating a lower substrate which is separated from the patch antenna of FIG. 1, and viewed from the top.

FIG. 5 is a top view illustrating the lower substrate 130 which is separated from the patch antenna 100 of FIG. 1, and viewed from the top. As shown in FIG. 5, a lower patch 135 is provided on a center of the lower substrate 130.

The lower patch 135 of the patch antenna 100 according to the exemplary embodiment is implemented in a square shape. However, this is merely an example. The lower patch 135 may be implemented in a shape other than the square shape.

The lower patch 135 is provided with two feeders 131 and 132. The feeders 131 and 132 provided in the lower patch 135 are fed with power through different power dividers.

Specifically, the feeder-1 131 is fed with power through a power divider-1 (not shown), and the feeder-2 132 is fed with power through a power divider-2 (not shown). Accordingly, different signals flow into the feeder-1 131 and the feeder-2 132.

When signals are fed into the feeders 131 and 132 and transmitted to the lower patch 135, the signals are coupled with the upper patch 115 such that electromagnetic waves are discharged from the patch antenna 100.

As shown in FIG. 5, a side (left side) of the lower patch 135 to which the feeder-1 131 is connected and a side (lower side) of the lower patch 135 to which the feeder-2 132 is connected are adjacent to each other (meet each other).

If a condition that the sides of the lower patch 135 to which the feeders 131 and 132 are connected are adjacent to each other is satisfied, the feeders 131 and 132 may be connected to other sides of the lower patch 135 unlike in FIG. 5.

For example, the feeder-1 131 may be connected to an upper side of the lower patch 135 and the feeder-2 132 may be connected to the left side of the lower patch 135, the feeder-1 131 may be connected to a right side of the lower patch 135 and the feeder-2 132 may be connected to the upper side of the lower patch 135, or the feeder-1 131 may be connected to the lower side of the lower patch 135 and the feeder-2 132 may be connected to the right side of the lower patch 135.

The feeders 131 and 132 shown in FIG. 5 are to transmit common signals to the lower patch 135. The feeders 131 and 132 may be replaced with feeders 133 and 134 to transmit differential signals to the lower patch 135 as shown in FIG. 6.

Figure 6:
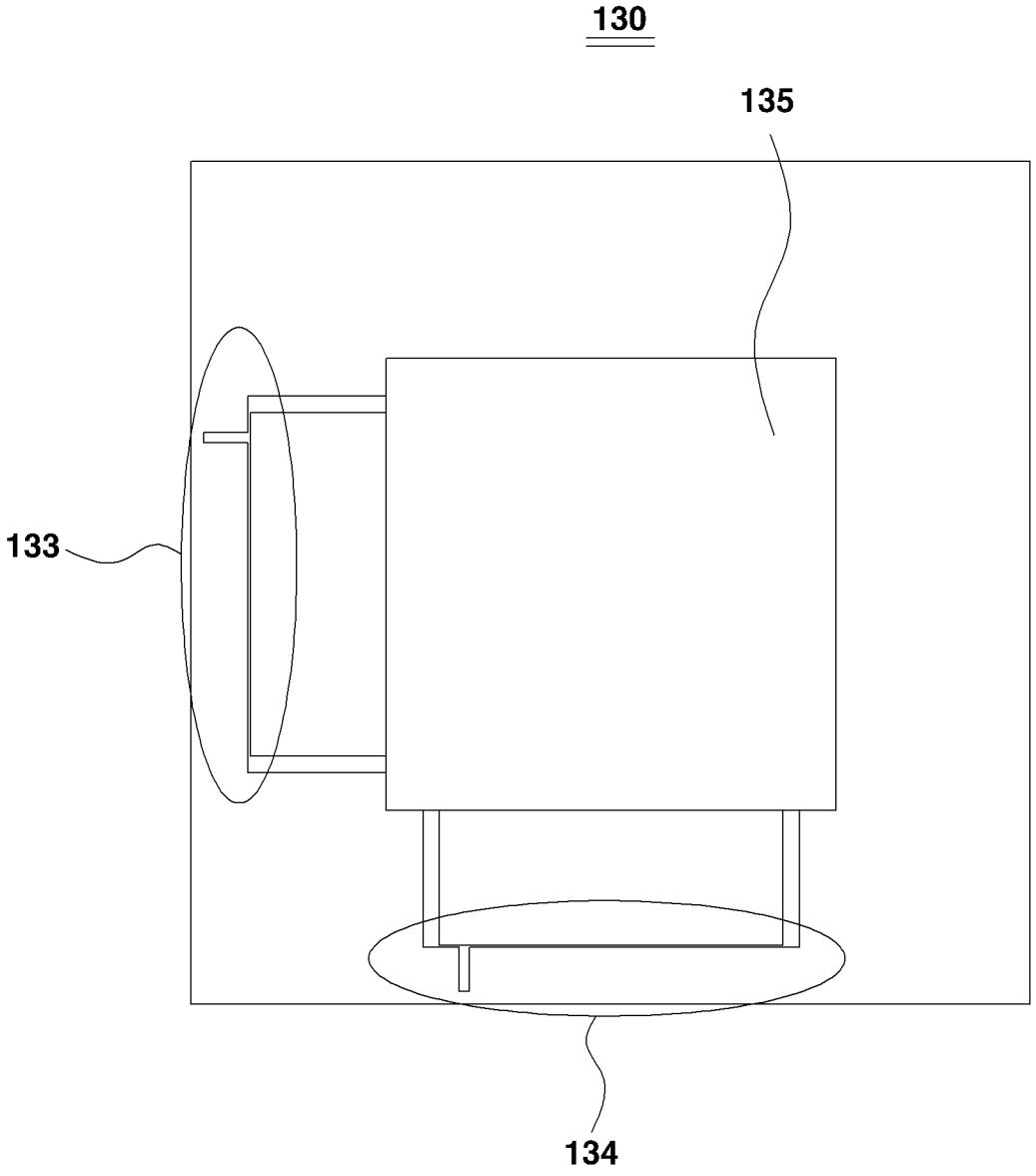
FIG. 6 is a top view illustrating a lower substrate in which feeders are replaced with feeders for differential signals.

In this case, if a condition that the sides of the lower patch 135 to which the feeders 133 and 134 are connected are adjacent to each other is satisfied, the feeders 133 and 134 may be connected to other sides of the lower patch 135 unlike in FIG. 6.

Up to now, the patch antenna having a single patch fed with multiple signals according to exemplary embodiments has been described.

The patch antenna proposed in the above-described exemplary embodiments may be embodied by an antenna that can transmit and receive circularly polarized waves as well as linearly polarized waves.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A patch antenna, comprising:

a lower substrate;

a first patch provided on the lower substrate;

a first feeder provided on the lower substrate, and connected to the first patch;

a second feeder provided on the lower substrate, and connected to the first patch;

metal sidewalls coupled to sides of the lower substrate;

an upper substrate disposed on the metal sidewalls; and a second patch provided on the upper substrate and parallel to the first patch, wherein the first feeder and the second feeder are connected to two adjacent sides of the first patch, respectively, wherein the first patch and second patch are a square shape;

wherein the metal sidewalls are disposed between the upper substrate and the lower substrate, wherein the metal sidewalls are formed in a cavity-back structure, wherein the metal sidewalls include four sidewalls forming four sides of a square shape, and wherein the four sidewalls are disconnected from each other at corners of the square shape.

2. The patch antenna as claimed in claim 1, wherein the first feeder is fed through a first power divider, and the second feeder is fed through a second power divider.

3. The patch antenna as claimed in claim 2, wherein the first feeder is configured to receive a first common signal, and the second feeder is configured to receive a second common signal.

4. The patch antenna according to claim 2, wherein the first feeder is configured to receive a first differential signal and the second feeder is configured to receive a second differential signal.

5. The patch antenna as claimed in claim 1, wherein the first patch and the second patch are configured to transmit and receive linearly polarized waves.

6. The patch antenna according to claim 1, wherein the first patch and the second patch are configured to transmit and receive circularly polarized waves.

* * * * *